United States Patent [19]

Müller et al.

[11] 3,965,783

[45] June 29, 1976

[54] AUTOMATIC SLICING MACHINE FOR FOOD STUFFS

[75] Inventors: Ernst Müller; Albrecht Maurer, both of Balingen, Germany

[73] Assignee: Bizerba-Werke Wilhelm Kraut K.G., Balingen, Wurttemberg, Germany

[22] Filed: Mar. 17, 1975

[21] Appl. No.: 559,366

[30] Foreign Application Priority Data

Mar. 21, 1974 Germany ..... 2413711

[52] U.S. Cl. ..... 83/88; 83/90; 83/112; 83/155.1; 83/730

[51] Int. Cl.[2] ..... B26D 4/46

[58] Field of Search ..... 83/88, 90–92, 83/112, 155, 155.1, 730

[56] References Cited

UNITED STATES PATENTS

| | | | |
|---|---|---|---|
| 1,976,855 | 10/1934 | McKee et al. | 83/88 |
| 2,073,082 | 3/1937 | Walter | 83/88 |
| 2,744,553 | 5/1956 | Folk | 83/88 |
| 2,834,388 | 5/1958 | Meyer | 83/91 X |
| 2,845,970 | 8/1958 | Folk | 83/730 |
| 3,842,698 | 10/1974 | Fitch | 83/91 X |

*Primary Examiner*—J. M. Meister
*Attorney, Agent, or Firm*—Charles F. Schroeder

[57] ABSTRACT

Apparatus for slicing food stuffs such as cold meat, sausage and cheese wherein the sliced sections can be selectably stacked or fanned automatically, moved away from the slicing zone, then lifted and moved transversely to a ready station without disorientation or abuse of the sliced foodstuffs.

9 Claims, 5 Drawing Figures

AUTOMATIC SLICING MACHINE FOR FOOD STUFFS

This invention concerns a cold meat slicing machine with an adjustable setting for the thickness of cut as well as a motor-driven carriage for the slicing stock which is displaceable on a machine housing to and fro relative to a rotating circular knife, with a clamping device arranged on the carriage for securing the slicing stock, and with driven belt and roller means for removing the severed slices.

Slicing machines of this type serve to cut food stuffs of large size into slices, and in particular meat and sausage goods as well as cheeses of a wide variety of cross-sectional shapes and cross-sectional dimensions. In operating such machines, particular importance is attached to hygiene, and non-abusive or delicate treatment of the slices as well as economy of operation. Known machines of this kind have the disadvantage, that during the withdrawal of portions of a selected number of slices deposited upon a conveyor belt, particularly in the case of portions in fanned formation, one must use auxiliary means, such as for example forks or spatulas.

According to experience, individual slices in such an arrangement may be easily and are frequently displaced relative to one another such that the desired appearance of the portions is much impaired. Additionally, in the case of delicate slicing stock, such as for example, pates, individual slices are easily and often torn or compressed, resulting in appreciable loss.

These defects are in practice in part remedied by hand replacement and realignment of the missing slices or by resorting to the aforementioned auxiliary means, which in either instance is unhygienic or time consuming and uneconomical.

In view of the foregoing, it is the object of the invention to overcome these defects by providing an automatic removal device arranged and constructed so that the portions sliced are fanned in the deposit direction and are then transported obliquely in the deposit direction by a conveyor belt, so that all slices of a portion lying at the end of the belt are simultaneously deposited upon suitable supports or directly into wrapping shells upon advancement of the conveyor belt.

In the preferred embodiment of a cold meat cutting machine according to the present invention, the removal device includes a removal transport belt, a roll way and a portions transport belt. The individual slices are deposited upon the deposit transport belt, which is made up of a plurality of parallel spaced individual belts which can be moved linearly at a selectable speed in the deposit direction. Rollers of a roll way which in initial position lie at a level underneath the slice deposit surface of the transport belt formed by the individual belts, are positioned in the spaces between the individual belts of the deposit transport belt. The portions of sliced foods comprise a preselected number of slices which are lifted from the deposit transport belt by a lifting stroke motion of the rollers of the roll way and transferred to the portions transport belt, which runs at a linear speed in synchronism with the roll way and the associated driving and deflecting rollers which have axes of rotation parallel to the rollers of the roll way.

In this manner, the fanned rows are arranged to be brought transversely from the region and direction of movement of the deposit transport belt onto the portions conveyor belt and upon further transport beyond the end of the portions conveyor belt transferred to a suitable support without abuse or misalignment of the slice formation of the individual portions.

Furthermore, the invention permits the course of operations to be controlled from a control panel having an electronic slice count device as well as the capability of pre-selection of the deposited portion formation (stacked or fanned) and the degree of slice overlap in fanned formations.

Moreover, the invention permits automatic monitoring by incorporating a suitable monitoring element, preferably a light barrier, such as a photoelectric cell and activating light beam source provided at the end of the portions transport belt by which an unintended further transport of the portions beyond the end of the belt is prevented.

Correspondingly, the possibility exists of processing one to three pieces of slicing stock simultaneously, wherein for each program cycle, one to three portions are stacked or fanned, respectively, in spaced relation. It is furthermore provided in a preferred embodiment to sub-divide the transport step of the portions transport belt, as determined by processing one piece of slicing stock into two or three individual portions or the sequential processing of two or three portions of the slicing stock, respectively, wherein the sub-division is settable at a preselector switch of the control desk whereby a series of cutting and transport steps can be triggered sequentially by activation of a start key in proper time spaced relation, so that the different portions slicing program cycles do not overlap one another.

The following description will provide further explanation in the context of the accompanying drawing.

Figure 3:
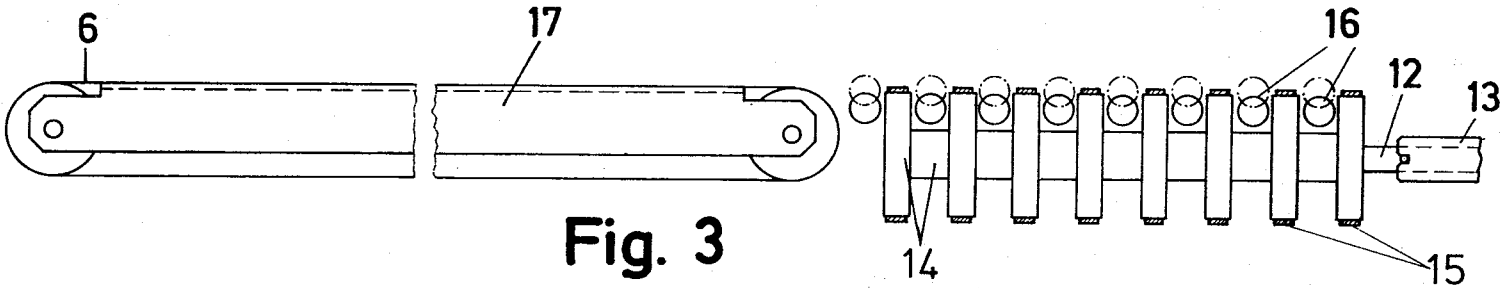
FIG. 3 is a schematic illustration of the constructional elements of the deposit transport belt, roll way and portions transport belt of the slicing machine shown in FIG. 1.
Figure 3A:
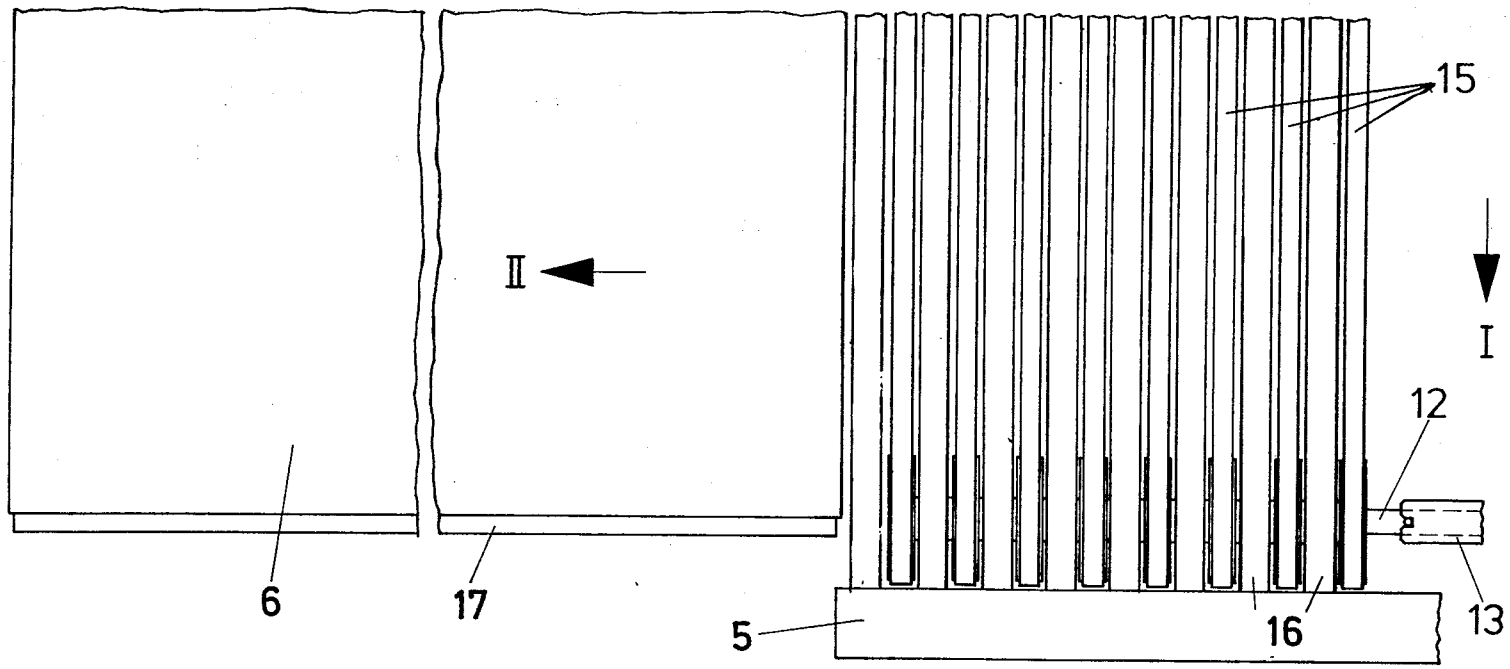

FIG. 3*a* is a partial plan view of the conveyor shown in FIG. 3.

Figure 1:
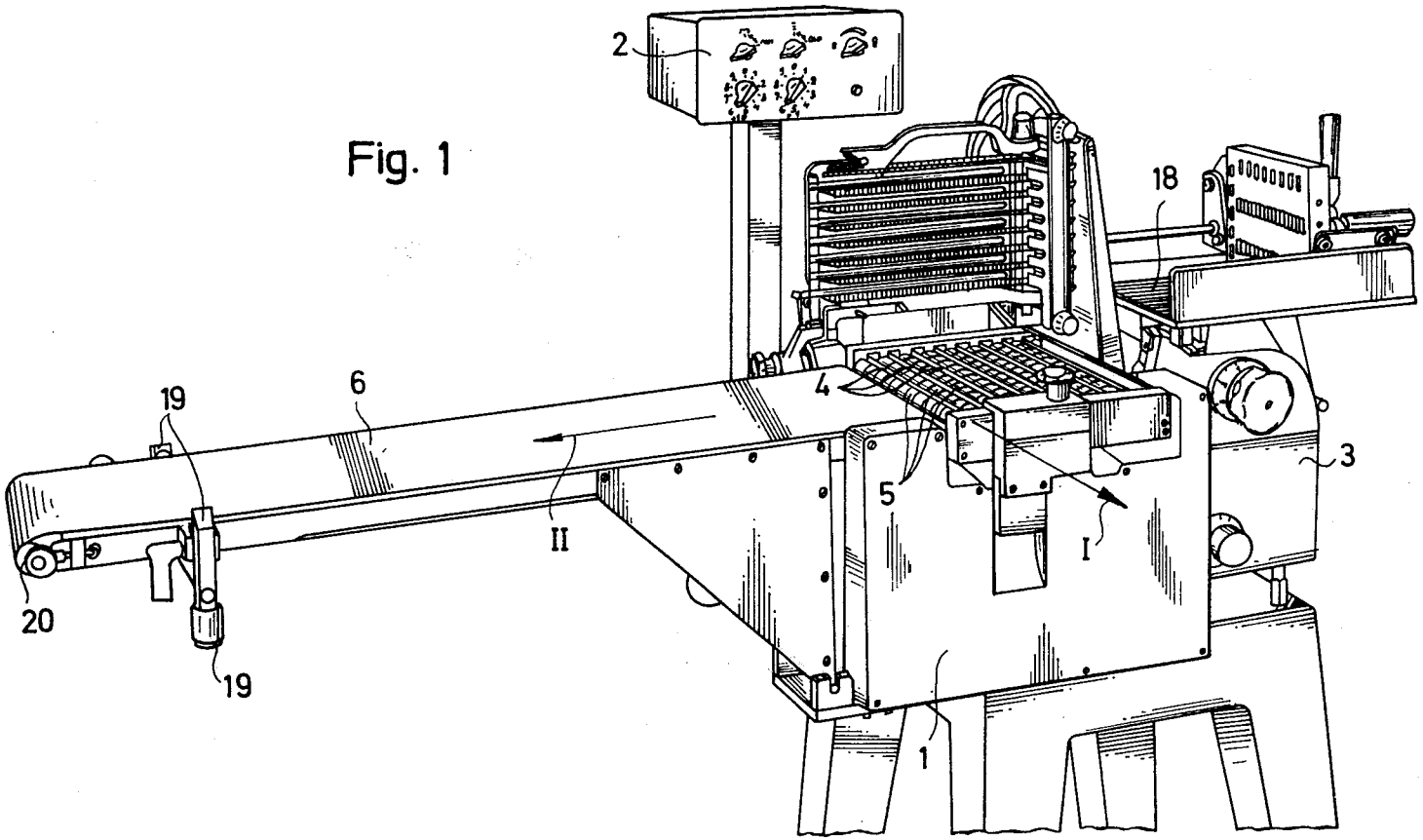
FIG. 1 is an overall perspective view of an automatic slicing machine with the portions removal device associated therewith according to the present invention.
Figure 4:
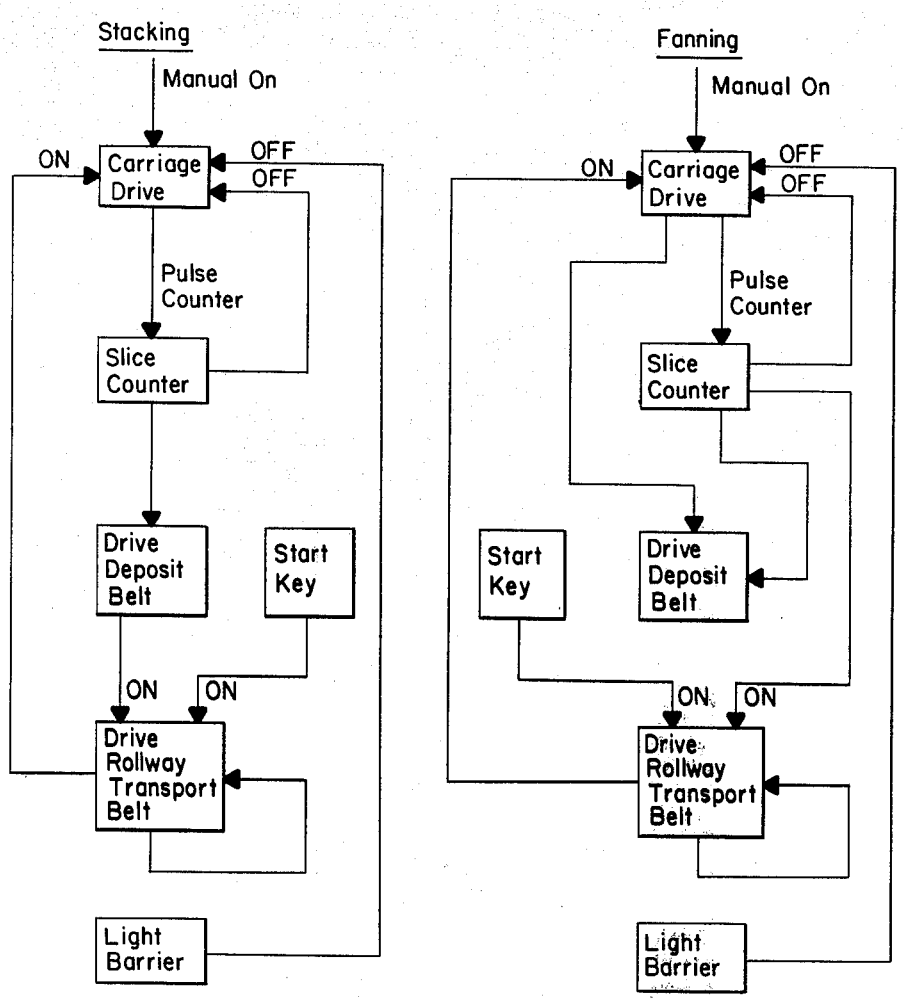

FIG. 4 is an overall schematic block diagram of the stacking and fanning functions performed by the automatic slicing machine of FIG. 1.

The drive unit 1 (of FIG. 1) and the control desk 2 are rigidly connected with the slicing machine 3. Included in the drive unit 1 are the support carrier and driving mechanisms for the deposit-transport belt 4, the roll way 5 and the portions transport belt 6. For hygienic reasons, the slice deposit-transport belt 4 made up of individual belts 15, roll way 5 and portions transport belt 6 are so assembled with the housing of the drive unit 1, that they are easily removable therefrom for cleaning without need for auxiliary tools.

Figure 2:
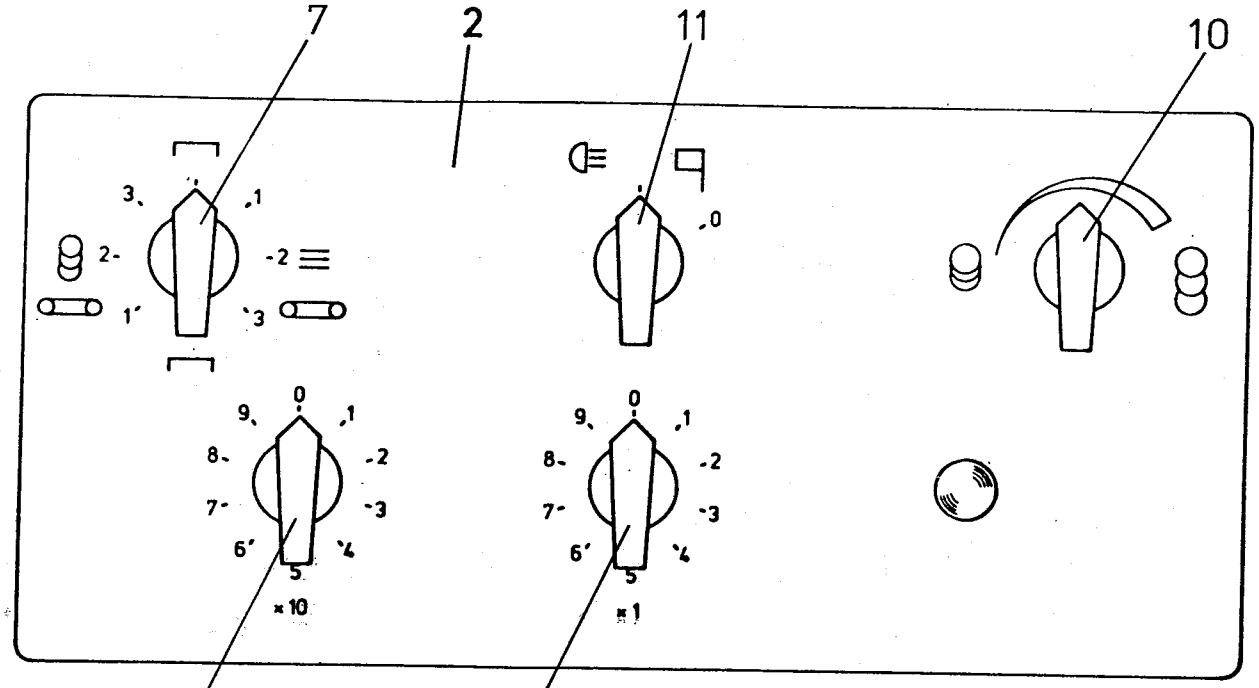
FIG. 2 is a front elevation view of the control panel for the slicing machine of FIG. 1.

For the preselection of different program cycles, the control desk 2 as shown in FIG. 2 possesses preselection switches including a deposit conveyor belt stacking/fanning selector switch 7, the portion count switches 8 and 9 for single slices and multiples of 10 slices, respectively, the fan spacing switch 10 and the light barrier switch 19.

The schematic block diagram of FIG. 4 shows the functions performed according to the program control.

As shown in FIG. 3 the deposit transport belt 4 is driven by a shaft 12 through a hollow coupling shaft 13 of the drive unit. The power for driving the roller 14 for the individual belts 4 is provided by a geared direct current motor (not shown), which is controlled in its speed of rotation, and which is suitably situated in the drive unit 1. With the preselector switch 7 (FIG. 2) set for fanned portions, the individual belts 15 advance in the direction of arrow I during deposition of slices on the belt surface 4 for the production of fanned portions. The fan spacing or degree of overlap is steplessly settable at the switch 10 (FIG. 2).

Upon attainment of the desired number of slices set at the count-preselector switches 8 and 9, the roller and belt drive motor is automatically switched off.

With the preselector switch 7 set for "stacking", the drive motor is switched off during the deposit of the slices into a stack and is briefly switched on upon attainment of the desired preselected number of slices, so that the stacked slices are moved forward in the direction of arrow I toward the mid-region of the roll way 5.

The roll way 5 (FIG. 3) is vertically displaceably by any of a number of suitable means such as solenoid, a piston, a cam or stroke gear arrangement which moves the assembly of rolls 16 between a lower and an upper end position. In the lower end position, the rolls 16 are so positioned in the spaces between the belts 15 of the dposit transport belt 4 that the zenithal lines, or uppermost surface portion, of the rolls 16 lie underneath the belts 15. After deposition of a preselected number of slices on the belts 15, the roll way is displaced into its upper position causing the slices to be lifted off the belts 15.

The width of the belts 15 is sufficiently narrow that the spacing between the rolls 16 is close enough to allow the rolls to bear the food portions lifted thereon without distortion of the food therebetween under its own weight. Correspondingly, the diameter of the rolls is such that the spacing between the belts 15 is sufficiently small to allow the belts to carry food portions deposited thereon without distortion under their own weight in the free spaces between the belts.

Simultaneously with lifting of a food portion, the rollers 16 and the portions transport belt 17 are driven in synchronism at the same linear speed by a second geared motor in the drive unit 1 to transport the slices through a predetermined distance, hereinafter designated as transport step in the direction of arrow II, so that the slices lie on the portions transport belt 17. The deposit transport belt 4 and roll way 5 are thus again empty. Upon completion of the transport step, the roll way 5 and the portions transport belt 17 are switched off.

The drive of the conventional slicing stock feed carriage 18 (FIG. 1) is switched off each time the upward stroke motion of the roll way is effected and started up again upon its return into the lower end position. When the preselector switch 7 is set at "fanning", the drive for the deposit transport belt 4 is started up again simultaneously with return of the roll way into its lower end position.

In the setting O of the switch 11 the light barrier 19 is made ineffective and the set program cycle repeats itself over and over again in uninterrupted sequence.

Upon turning the switch 11 for the light barrier 19 to its on position, the set program cycle is carried through until a sliced portion comes into the monitoring region of the light barrier 19, whereupon a pulse is triggered.

This pulse switches a preparatory contact, so that after placing the next succeeding portion into a ready position, the drive for the slicing stock carriage 18 and the drive for the deposit transport belt 4 are switched off without the roll way drive and the portions transport belt drive being switched on. If a pushbutton start key (FIG. 4) is then actuated, the portions transport belt 6 is again activated overriding the light barrier and moves in the direction of arrow II to deposit the portion lying next adjacent to the deflector roller 20 upon a support.

Simultaneously, the roll way 5 brings the slices lying upon the deposit transport belt 4 onto the portions transport belt 6. The portion brought anew by the transport step into the monitoring region of the light barrier generates the above-described pulse, so that one portion is placed in a ready position and the drive for the slicing stock carriage and the deposit transport belt are again switched off.

The positions 1, 2 and 3 of the preselector switch 7, in the case of setting the switch to "stacking" as well as in the case of the setting the switch to fanning, adjust the transport step to the number of the slicing stock portions to be processed simultaneously. In the setting 1, the transport step is carried through its full length on actuation of the start key. In the setting 2 or 3, the transport step is subdivided to handle two or three portions, respectively, in the overall cycling of the apparatus.

While a particular preferred embodiment of the invention has thus been shown and described, it is intended by the appended claims to cover all such modifications that fall within the true spirit and scope of the invention.

We claim:

1. In combination with a food slicing machine having a rotating slicing blade for cutting food stock such as meats and cheese and an advancable and transversely reciprocable carriage for support and movement of the food stock toward as well as transversely across the cutting edge of the slicing blade to cut and supply in sequence severed slices of such stock, a slice removing means disposed in the slice release region of said blade comprising a linearly moveable planar deposit surface comprising a plurality of parallel side-by-side spaced individual transport belts providing individual longitudinal surfaces each moveable linearly in a direction away from said slicing blade, said deposit transport belts having associated interspaced rolls below said belts moveable into a position of projection above the deposit surface level of said belts for lifting of foodstuffs from said belts and movement thereof transversely to the direction of movement of said belts.

2. A food slicing machine combination as set forth in claim 1 wherein the moveable deposit surface has an associated speed adjustment means permitting preselection of the speed of movement of said surface away from said blade for a desired degree of slice overlap as a series of severed slices are supplied thereto.

3. A food slicing machine as set forth in claim 1 wherein the width of said transport belts is sufficiently narrow that the spacing between the interspaced rolls is close enough that foodstuff lifted thereon will be borne without distortion under its own weight into the spaces between said rolls.

4. A food slicing machine according to claim 3 wherein the diameter of said rolls is sufficiently small that the spacing between said belts is sufficiently small that foodstuff deposited on said belts can be conveyed linearly thereon without distortion under its own weight into the spaces between said belts.

5. In combination with a food slicing machine having a rotating slicing blade for cutting food stock such as meats and cheese and an advancable and transversely reciprocable carriage for support and movement of the food stock toward as well as transversely across the cutting edge of the slicing blade to cut and supply in sequence severed slices of such stock, a slice removing means disposed in the slice release region of said blade comprising a linearly moveable planar deposit surface comprising a plurality of parallel side-by-side spaced individual transport belts providing individual longitudinal surfaces each moveable linearly in a direction away from said slicing blade, a plurality of rotatable longitudinal rolls having axes of rotation aligned parallel with the deposit surface of said transport belts, each adjacent pair of said belts having one of said rolls disposed in the vertical space region therebetween, said rolls being moveable to a position below said slice deposit surface to permit free movement of grouped food slices away from the slicing blade by said transport belts, said rolls also being selectably moveable upwardly in unison to lift sliced foodstuffs from said slice deposit surface of the belts whereby upon rotation of said rolls the food slices are moved as a group in a direction transverse to the direction of movement on said belts.

6. A food slicing machine according to claim 5 wherein the rolls during deposit of slices upon said transport belts lie underneath the deposit plane of said belts and after the attainment of a preselected number of slices, said rolls are lifted to transport said slices in a lateral direction.

7. A food slicing machine according to claim 6 wherein a portions transport belt is disposed laterally of said belts and rolls to receive and move slice portions to a ready station.

8. A food slicing machine according to claim 7 wherein said portions transport belt has an associated photocell light barrier unit positioned along its length and which upon movement of a slice portion into its monitored range halts further movement of the belt and slice portion thereon.

9. A food slicing machine according to claim 8 wherein control means interconnect said light barrier is arranged to initiate slicing of foodstuff upon withdrawal of a slice portion disposed in the monitoring range of the light barrier.

* * * * *